US006996942B2

(12) United States Patent
Geiger

(10) Patent No.: US 6,996,942 B2
(45) Date of Patent: Feb. 14, 2006

(54) CONSTRUCTING GEODESIC DOMES

(76) Inventor: David S. Geiger, 13409 Fernando Ave., Apple Valley, MN (US) 55124

( * ) Notice: Subject to any disclaimer, the term of this patent is extended or adjusted under 35 U.S.C. 154(b) by 96 days.

(21) Appl. No.: 10/355,387

(22) Filed: Jan. 30, 2003

(65) Prior Publication Data

US 2003/0213186 A1 Nov. 20, 2003

Related U.S. Application Data

(60) Provisional application No. 60/381,757, filed on May 16, 2002.

(51) Int. Cl.
*E04B 7/08* (2006.01)
*E04H 12/00* (2006.01)

(52) U.S. Cl. ..... 52/81.3; 52/81.4; 52/81.1; 446/116; 446/126

(58) Field of Classification Search ..... 52/655.1, 52/655.2, 81.1, 81.3, 81.4, 656.9, 650.2, 52/652.1, 656.7; 446/127, 116, 104, 126
See application file for complete search history.

(56) References Cited

U.S. PATENT DOCUMENTS

| | | | | | |
|---|---|---|---|---|---|
| 2,978,074 | A | * | 4/1961 | Schmidt | 52/81.2 |
| 3,137,371 | A | * | 6/1964 | Nye | 52/81.2 |
| 3,186,522 | A | * | 6/1965 | McCauley | 52/663 |
| 3,333,375 | A | * | 8/1967 | Johnston | 52/81.3 |
| 3,810,336 | A | * | 5/1974 | Sadao | 52/81.2 |
| 3,881,284 | A | * | 5/1975 | Martin | 52/81.1 |
| 3,909,994 | A | * | 10/1975 | Richter | 52/63 |
| 4,009,543 | A | * | 3/1977 | Smrt | 52/81.2 |
| 4,012,872 | A | * | 3/1977 | Stolpin | 52/81.3 |
| 4,244,152 | A | * | 1/1981 | Harper, Jr. | 52/81.3 |
| 4,309,852 | A | * | 1/1982 | Stolpin | 52/81.3 |
| 5,452,555 | A | * | 9/1995 | Lee | 52/584.1 |
| 5,560,151 | A | * | 10/1996 | Roberts | 52/81.1 |
| 5,996,288 | A | * | 12/1999 | Aiken | 52/81.3 |
| 6,098,347 | A | * | 8/2000 | Jaeger et al. | 52/81.3 |
| 6,108,984 | A | * | 8/2000 | Davidson | 52/81.1 |
| 6,722,086 | B2 | * | 4/2004 | Boots | 52/81.3 |
| 6,748,962 | B2 | * | 6/2004 | Miller | 135/130 |

OTHER PUBLICATIONS

"The Vacation Home You Store In Your Garage", Popular Science, p. 26, Oct., 2002.
"Rock–Solid Framing Technique", Mark Powers, This Old House Magazine, p. 20, Nov., 2003.
"Design: Yurts Come Out of the Woods", Ashley Chapman, Wall Street Journal, Aug. 29, 2003.
"A New Product Line From The Succussful Canadian Plastics Producer: Royal Homes For Developing Nations Help Cut Costs", Andy Turnbull, Automated Builder, pp. 14–15, Oct., 2002.
*Dome Book 2*, by Pacific Domes, pp. 108–109, May, 1971.
"Wood Construction Connectors", Simpson Strong–Tie Co., Inc., 2001, Catalog C–2002.
"Discover the Strength", Reaves Building Systems, Brochure.
J. Baldwin, "Bucky Works—Buckminster Fuller's Ideas for Today", 1996, pp. 207–216.

* cited by examiner

*Primary Examiner*—Anita M. King
(74) *Attorney, Agent, or Firm*—Shumaker & Sieffert, PA

(57) ABSTRACT

Techniques are described for constructing geodesic dome structures. For example, a method includes connecting a set of temporary spacers to a set of connectors. The spacers arrange the connectors in space so that the connectors are referenced with respect to one another to form the geometries of a geodesic dome. The method may further include making the temporary geodesic dome structure permanent. The techniques described may allow the construction of a geodesic dome structure of precisely controlled dimensions with relatively small numbers of people and little strenuous labor.

45 Claims, 13 Drawing Sheets

(A)

(B)

(A)

(B)

CONSTRUCTING GEODESIC DOMES

This application claims priority from U.S. Provisional Application Ser. No. 60/381,757, filed May 16, 2002, the entire content of which is incorporated herein by reference.

TECHNICAL FIELD

The invention relates to geometrically shaped buildings, and more particularly, to constructing geodesic domes.

BACKGROUND

A geodesic dome is a type of structure constructed with straight elements that form interlocking polygons. The structure is comprised of a complex network of polygons, usually triangles, which form a roughly spherical surface. The more complex the network of polygons, the more closely the dome approximates the shape of a sphere.

There have been many different techniques studied to construct a geodesic dome, including constructing the geodesic dome with a framework or without a framework. The techniques include using permanent rods and connectors as a framework, using interlocking panels as a framework, and using interlocking panels without a framework. The techniques that use frameworks may further include enclosing the framework. Many of these techniques may involve hard labor and machinery to lift heavy materials. The geodesic domes may take weeks or even months to construct.

SUMMARY

In general, the invention is related to techniques for constructing geodesic dome structures. The techniques may be used, for example, for constructing geodesic domes with relatively small numbers of people and little strenuous labor. As described in detail, a set of temporary spacers and a set of connectors are assembled to form the geometries of a geodesic dome. More particularly, the temporary spacers reference the connectors with respect to one another in space to form the geometries of a geodesic dome structure. For example, the set of temporary spacers may be fastened to the connectors with fasteners such as nails, screws, bolts, or clamps. Alternatively, one or more strands of wire may be attached between the connectors to create a wire mesh. The wire mesh may be erected to form the geometries of the geodesic dome. In this manner, the strands of woven wire act as the temporary spacers.

Permanent structure members are added to form a permanent geodesic dome structure. For example, the permanent structure members may consist of wood, steel, or the like and may be fastened to the connectors in order to give the geodesic dome structure permanence. Alternatively, a curing material, such as a spray-on cement or epoxy, may be applied to the geodesic dome structure created by the set of temporary spacers and connectors. In some embodiments, the permanent structure members may enclose the geodesic dome structure. However, in the case in which the permanent structure members do not enclose the geodesic dome structure, panels may be fastened to the geodesic dome structure in order to enclose it.

The temporary spacers may be removed from the geodesic dome structure. For example, the temporary spacers may be removed as permanent structure members are fastened to the connectors. In the case in which the temporary spacers are removed, the temporary spacers may be connected to another set of connectors to form the geometries of another geodesic dome. In this fashion, the construction of geodesic dome structures may be done in an assembly line fashion. However, the temporary spacers may remain fastened to the connectors and become a passive part of geodesic dome.

In one embodiment, the invention provides a method comprising assembling a set of connectors and set of temporary spacers to form the geometries of a geodesic dome. The method further comprises fastening permanent structure members to the connectors to form a permanent geodesic dome structure.

In another embodiment, the invention provides an apparatus comprising a set of connectors and a set of temporary spacers that are connected to the connectors to form the geometries of a geodesic dome. The apparatus further includes a set of permanent structure members that fasten to the connectors to form a permanent geodesic structure.

The invention can provide a number of advantages. In general, the invention provides techniques for constructing geodesic domes with relatively small numbers of people and little strenuous labor. Further, the geodesic domes may be constructed in a relatively short period of time, e.g., hours or days. Constructing geodesic domes with small numbers of people, little strenuous labor, and in a short amount of time may be particularly useful for providing shelter for those who have lost homes from natural disasters, wars, or similar catastrophic event.

Further, the pieces of the geodesic dome, i.e., the temporary spacers, the connectors, the permanent structure members and the panels may come in a kit. The pieces may be color-coded to allow easy construction of the geodesic dome. For example, an illiterate person may construct the geodesic dome using the color-coded pieces. Also, the pieces of the geodesic dome may be constructed of materials that are cheap to produce in order to reduce the cost of the kit. The temporary spacers and other components may be manufactured to extremely small tolerances, thus assuring the completed domes will approach the theoretical geometries of the desired dome, in turn, increasing the stability of the dome. The fine precision in manufacturing the components of the dome also promotes ease of assembly.

The details of one or more embodiments of the invention are set forth in the accompanying drawings and the description below. Other features, objects and advantages of the invention will be apparent from the description and drawings and from the claims.

DETAILED DESCRIPTION

Figure 1:
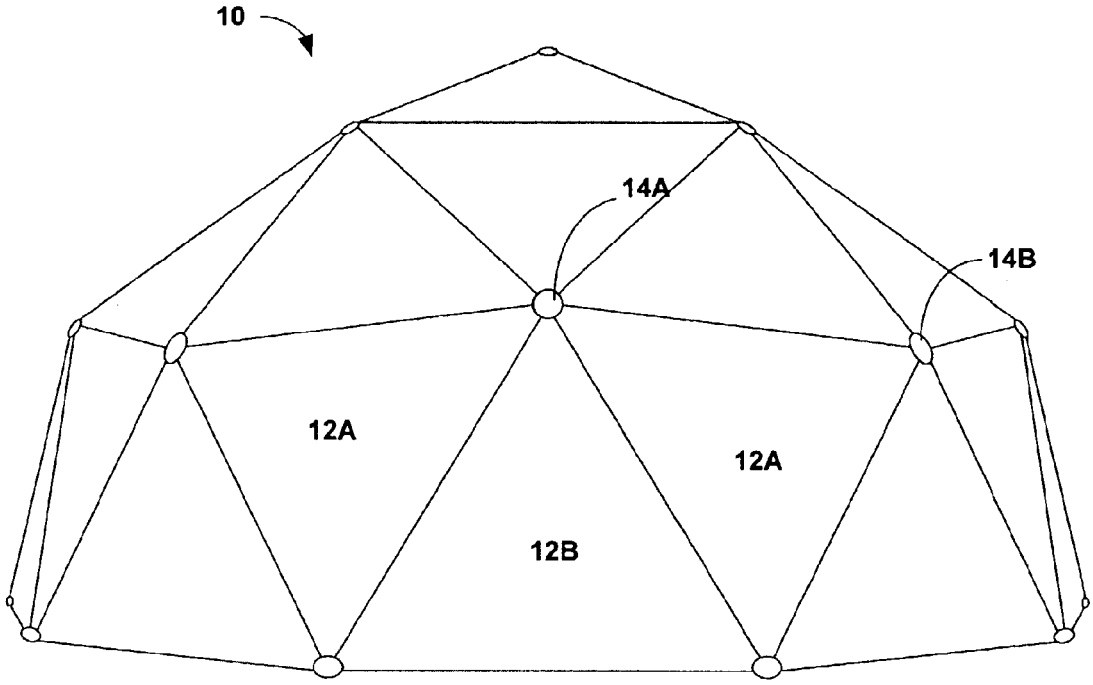
FIG. 1 is a schematic diagram illustrating a set of connectors referenced with respect to one another in space to form the geometries of a geodesic dome structure.

FIG. 1 is a schematic diagram illustrating a set of connectors 14 referenced with respect to one another in space to form the geometries of a geodesic dome structure 10. A set of temporary spacers 12 is fastened to a set of connectors 14 to reference connectors 14 with respect to one another in space, forming the geometries of geodesic dome 10. Temporary spacers 12 may be fastened to connectors 14 with fasteners such as screws, bolts, nails, clamps, or the like.

Temporary spacers 12 may be constructed of a rigid, yet lightweight material such as plastic, polystyrene, or the like. In the embodiment shown in FIG. 1, temporary spacers 12 are formed in the shape of triangles. However, temporary spacers 12 may be formed in the shape of any polygon or other shape that will define and hold the geometries in space until the desired geometries are fixed permanently in space. All temporary spacers 12 of geodesic dome structure 10 need not be the same size. For example, temporary spacers 12A may take the shape of isosceles triangles, whereas temporary spacers 12B may take the shape of equilateral triangles.

Connectors 14 are constructed from materials such as steel, plastic, or the like. Connectors 14 may be constructed to fasten to any number of temporary spacers 12. In the embodiment shown in FIG. 1, there are two types of connectors 14, each with a different shape. Connector 14A is a connector taking a shape similar to a hexagon, in that it fastens to six of temporary spacers 12, whereas connector 14B takes a shape similar to a pentagon. Connectors 14 may take the shape of numerous polygons depending on the number of temporary spacers 12 that fasten to connector 14. Alternatively, connectors 14 may take the shape of circles or other curved shapes. For example, connector 14 may be a circular piece, much like a link of a chain. The vertex of temporary spacers 12 may attach to one of circular connectors 14. Spacers 12 may rotate around the connector to seek an appropriate angle between spacer 12 and connector 14.

Figure 2:
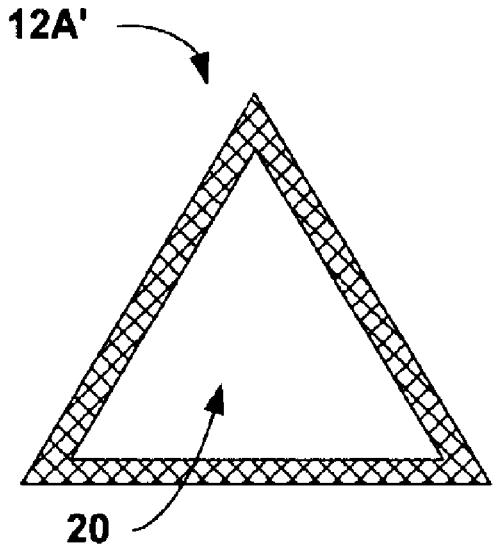
FIG. 2 is a schematic diagram illustrating exemplary spacers used to construct the geometries of a geodesic dome structure.
Figure 2:
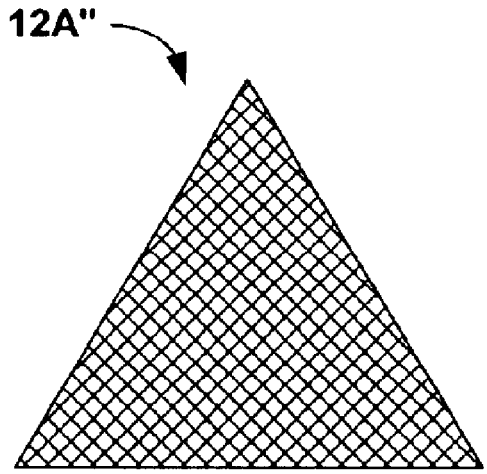

FIG. 2 is a schematic diagram illustrating exemplary temporary spacers 12 used to construct the geometries of a geodesic dome structure 10. FIG. 2(A) shows a spacer 12A', which takes the shape of an isosceles triangle. The material of spacer 12A' may form an outline of a triangle, that is, the sides of spacer 12A' may form a border that creates a triangular shaped hole 20 in the center of spacer 12A'. FIG. 2(B) shows a spacer 12A", which also takes the shape of an isosceles triangle. Spacer 12A", unlike spacer 12A', does not form a hole 20. Instead, spacer 12A" resembles a solid sheet of material shaped like a triangle. As mentioned previously, temporary spacers 12 may take the shape of any number of polygons. Furthermore, temporary spacers 12 may be a straight piece of material, such as a temporary strut.

Figure 3:
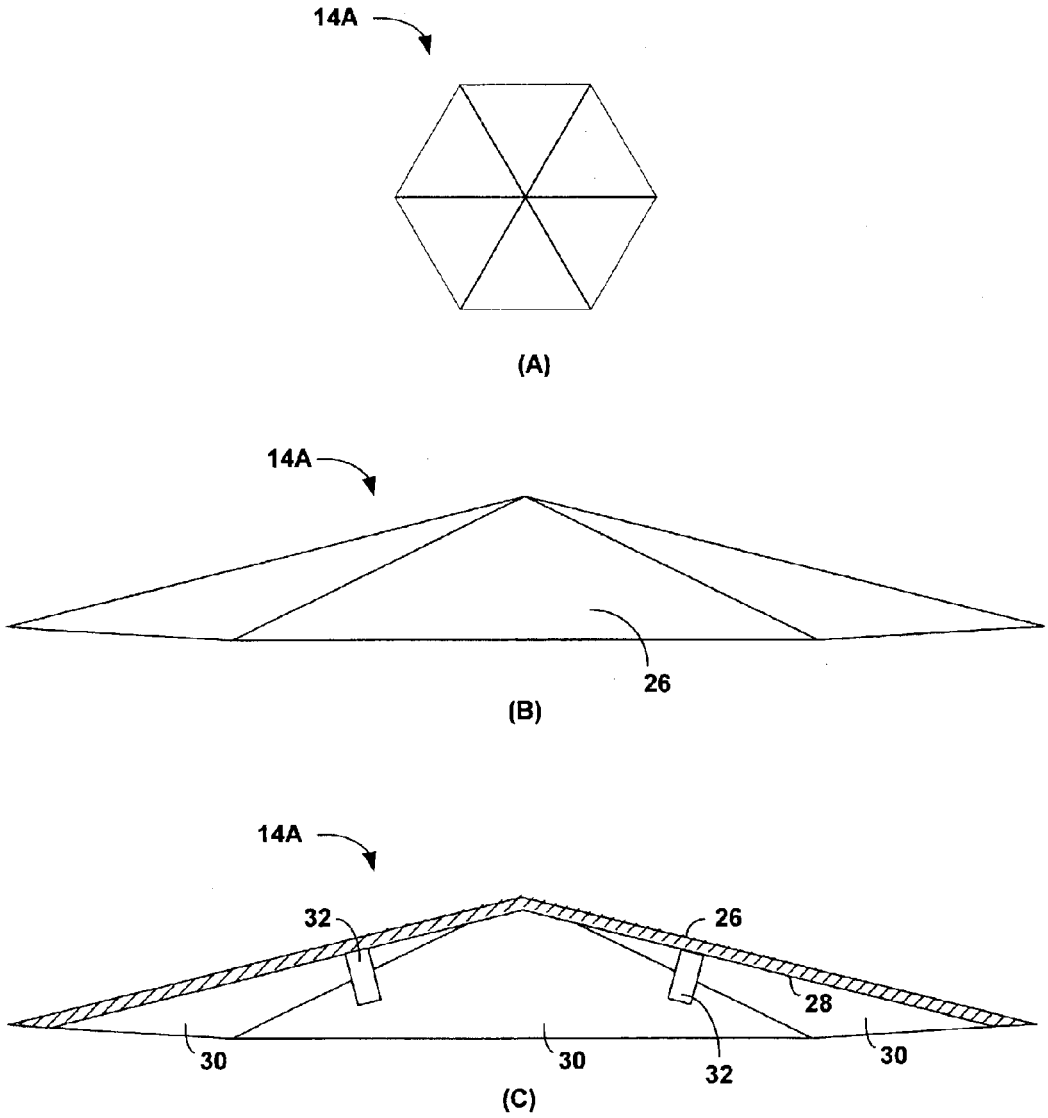
FIG. 3 is a schematic diagram illustrating an exemplary connector used to construct the geometries of a geodesic dome structure.

FIG. 3 is a schematic diagram illustrating an exemplary connector 14A used to construct the geometries of a geodesic dome structure 10. FIG. 3(A) shows a top view of connector 14A. The top view of connector 14A shows that connector 14A takes the shape of a hexagon. Connector 14A may be formed of one solid piece of material. Alternatively, connector 14A may be formed of multiple pieces of material that fit together to form connector 14A. For example, six triangular type pieces may be fastened together at appropriate angles to form connector 14A. Connector 14A may take the shape of any polygon. For example, connector 14B of FIG. 1 takes the shape of a pentagon.

FIG. 3(B) shows a side view of connector 14A. The side view of connector 14A shows an outer shell 26 of connector 14A, which has an angle of inclination, as opposed to being flat. The angle of inclination allows straight structures to be attached to connector 14A to form the structure of dome 10. Alternatively, connector 14A may be flat and the attaching structures may have an angle of inclination. The angle of inclination may be different depending on the shape of connector 14A. Furthermore, the angle of inclination may be different depending on the type of dome 10 that is to be constructed. For example, a dome 10 with a larger radius may have a smaller angle of inclination.

FIG. 3(C) shows a section view of connector 14A. Connector 14A includes an outer shell 26 and an inner shell 28. In the embodiment shown in FIG. 3(C), outer shell 26 is separated from inner shell 28 by the material from which connector 14A is constructed. However, a chamber of air may separate the shells 26, 28 in order to make connector 14A lighter. Inner shell 28 of connector 14A consists of a set of triangular shaped walls 30. In the embodiment shown in FIG. 3(C), inner shell 28 is constructed with six triangular shaped walls 30, three of which are shown. Each of walls 30 may have a fastening member 32 extending inward. Fastening member 32 may be a clamp, a bolt, a screw, or the like. Alternatively, each of walls 30 may have a receiving member (not shown in FIG. 3(C)). The receiving member would accept fastening members that may be adhered to a spacer 12, a permanent strut, a panel, or the like.

Figure 4:
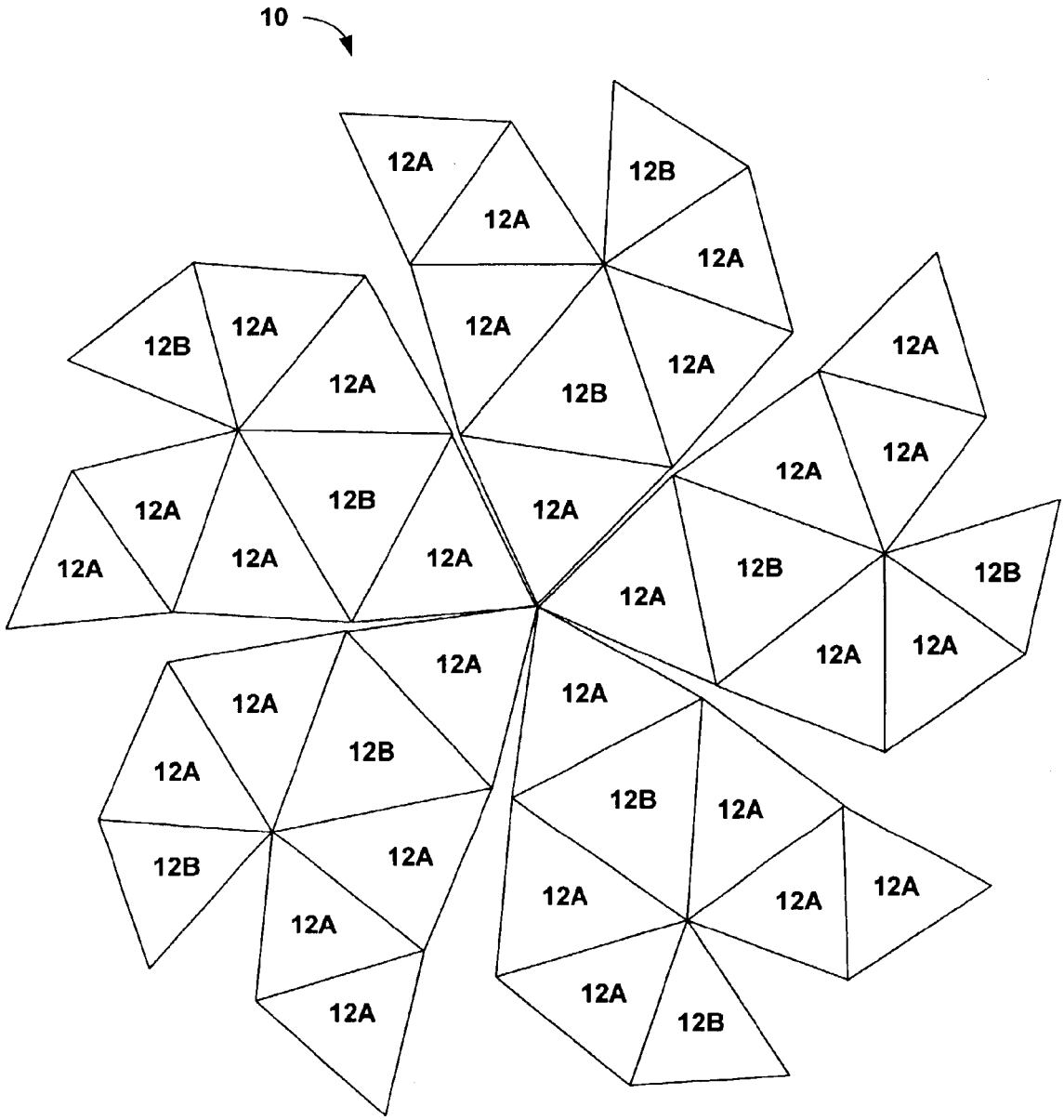
FIG. 4 is a schematic diagram illustrating a plan view of spacers arranged on a flat surface to illustrate the relation between the spacers before the spacers are collectively joined to create the geometries of a geodesic dome in space.

FIG. 4 is a schematic diagram illustrating a plan view of temporary spacers 12 arranged on a flat surface to illustrate the relation between the spacers before the spacers are collectively joined to create the geometries of a geodesic dome 10 in space. The plan view illustrates the relation of temporary spacers 12 with respect to one another. The structure of geodesic dome 10 is created using a set of connectors 14A, 14B, a plurality of temporary spacers 12A and a plurality of temporary spacers 12B. Spacers 12A take the shape of isosceles triangles. Spacers 12A may have holes 20 as spacer 12A' of FIG. 2, or be a solid sheet of material as spacer 12A" of FIG. 2. Spacers 12B take the shape of equilateral triangles and, like spacers 12A, may have holes 20 or be a solid sheet of material. It should be noted that FIG. 4 is not drawn to scale. For example, all of spacers 12A are of the same size and shape, as are spacers 12B.

Figure 5:
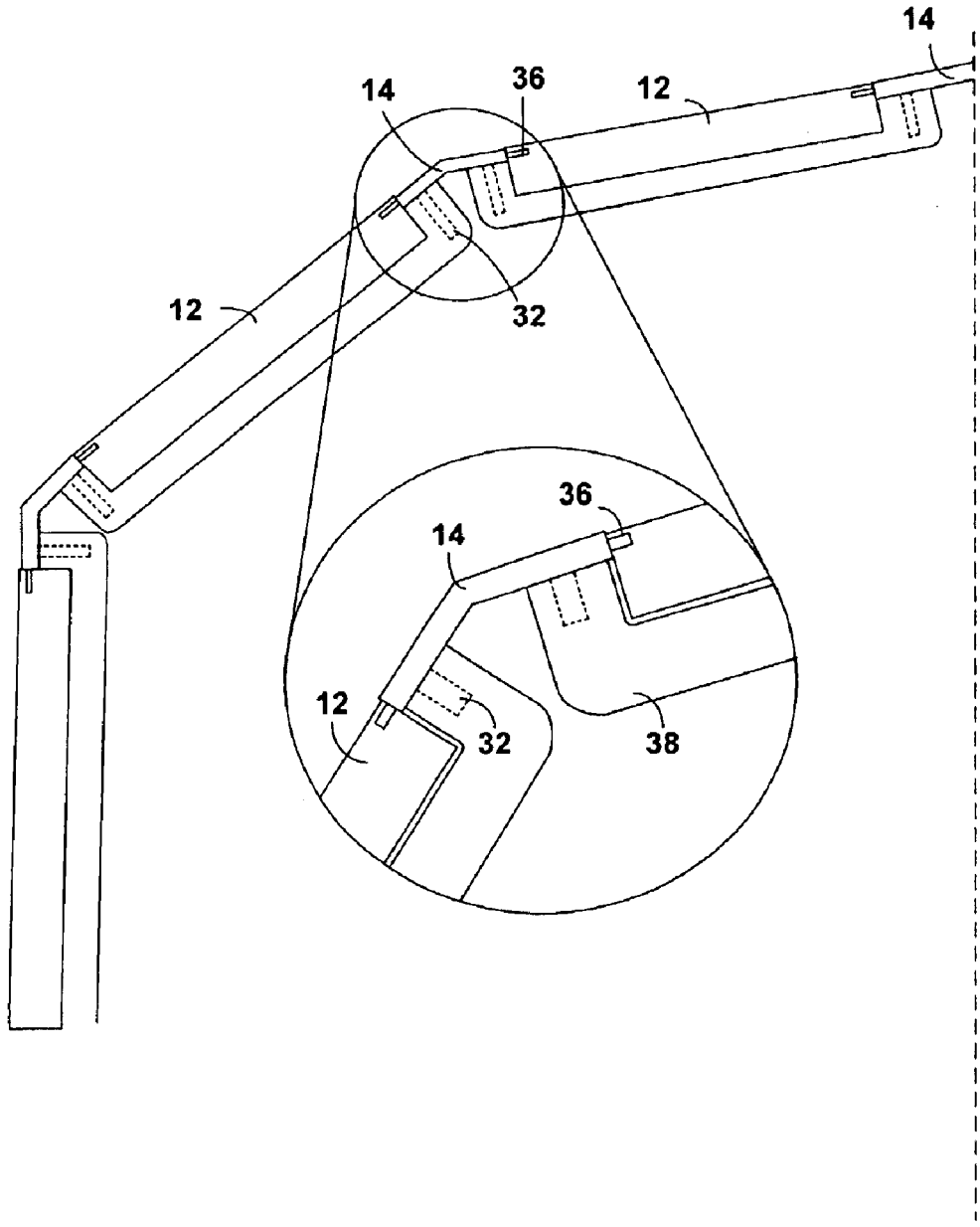
FIG. 5 is a schematic diagram illustrating a cross section of a geodesic dome structure.

FIG. 5 is a schematic diagram illustrating a cross section of a geodesic dome structure 10. Geodesic dome structure 10 comprises a plurality of temporary spacers 12 that fasten to a plurality of connectors 14 to form the geometries of geodesic dome structure 10. In the embodiment shown in FIG. 5, the geometries of dome 10 are constructed with three tiers of temporary spacers 12. Any number of tiers of temporary spacers 12 may be used depending on the size of dome 10 that is to be constructed. Each of temporary spacers 12 connects to at least one of connectors 14 via fastener 36. Fastener 36 may extend from connector 14 and be received by spacer 12. Alternatively, fastener 36 may extend from spacer 12 and be received by connector 14. Fastener 36 may not extend from either spacer 12 or connector 14, but instead may be a separate entity that fastens spacer 12 to connector 14 such as a bolt, screw, clamp, nail or the like.

Geodesic dome 10 further comprises a set of permanent structure members 38 that may be fastened to connectors 14. Permanent structure members 38 may be formed to have a receiving member (not shown in FIG. 5) to receive a fastener 32 that may extend from connector 14. Alternatively, fastener 32 may extend from permanent structure member 38 and be received by connector 14. Fastener 32 may not extend from either structure member 38 or connector 14, but instead may be a separate entity that fastens connector 14 to structure member 38, such as a bolt, screw, clamp, nail or the like. Permanent structure member 38 may be fastened to connector 14 on the outside of spacer 12. Alternatively, structure member 38 may be fastened to connector 14 on the inside of spacer 12. Permanent structure member 38 may be constructed from materials such as wood, plastic, steel, cable, or the like.

Figure 6:
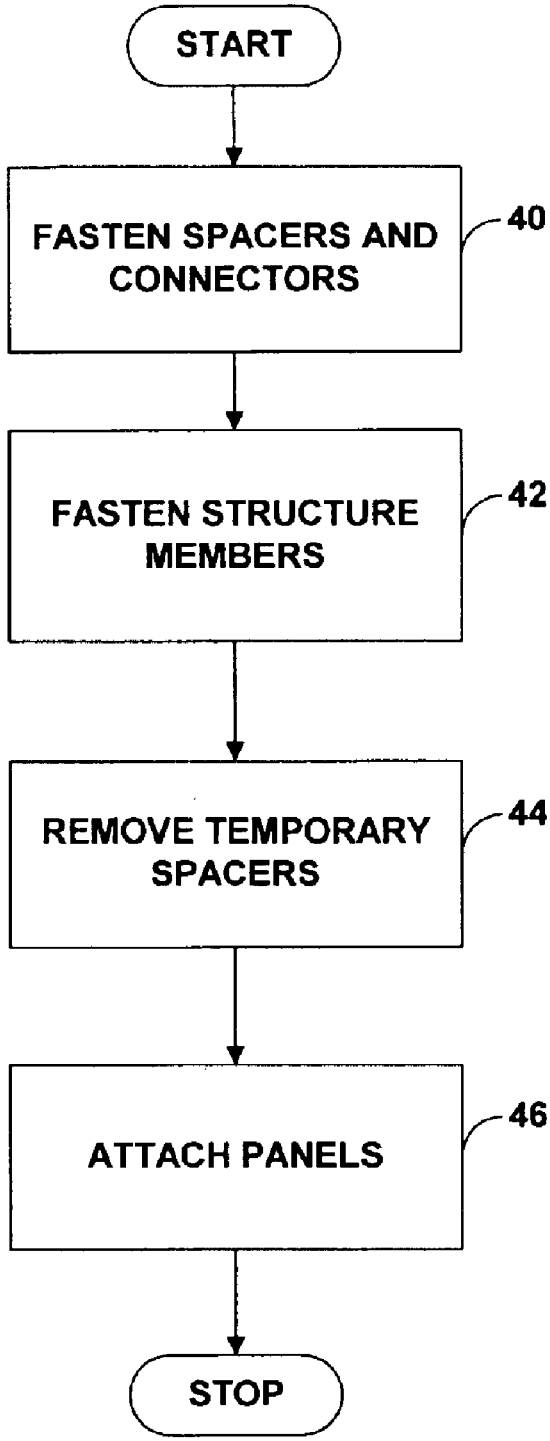
FIG. 6 is a flow chart illustrating the construction of a geodesic dome structure.

FIG. 6 is a flow chart illustrating the construction of a geodesic dome structure. A set of temporary spacers 12 is fastened to a set of connectors 14 to reference connectors 14 in space relative to one another (40). Connectors 14 and temporary spacers 12 form the geometries of geodesic dome structure 10. Temporary spacers 12 may be fastened to connectors 14 using bolts, screws, nails, clamps or the like. Temporary spacers 12 may be fastened to connectors 14 beginning from a tier nearest the ground and building upwards. Alternatively, temporary spacers 12 may be fastened to connectors 14 beginning with a top tier and building downwards. Geodesic dome structure 10 formed by connectors 14 and temporary spacers 12 may be sturdy enough to stand freely.

Once temporary spacers 12 and connectors 14 form the geometries of geodesic dome structure 10, permanent structure members 38 may be fastened to connectors 14 to make geodesic dome structure 10 permanent (42). Permanent structure members 38 may be fastened to connectors using bolts, screws, nails, clamps or the like. As mentioned above, structure members 38 may be fastened either outside or inside of spacer 12. As with temporary spacers 12, structure members 38 may be fastened to connectors 14 beginning from a tier nearest the ground and building upward or from a top tier and building downward.

Temporary spacers 12 may be removed as permanent structure members 38 are fastened to connectors 14 (44). For example, after fastening one of permanent structure members 38 to connectors 14 along each of the three sides of one of spacers 12, spacer 12 may be removed. However, temporary spacers 12 may remain in place until all of permanent structure members 38 are fastened to connectors 14 and then temporary spacers 12 may be removed. Temporary spacers 12, once removed, may be discarded. Alternatively, the removed temporary spacers 12 may be used to reference another set of connectors 14 to form the geometries of another geodesic dome 10. In this fashion, the construction of geodesic dome structures may be done in an assembly line fashion. However, spacers 12 may remain fastened to connectors 14 and become a passive part of geodesic dome 10.

Panels may be attached to permanent structure members 38 and connectors 14 to enclose geodesic dome structure 10 (46). The panels may be attached to connectors 14, to permanent structure members 38, or both. The panels may be attached to connectors 14 in the same fashion as attaching structure members 38 to connectors 14. The panels may be attached to permanent structure members 38 using fasteners such as bolts, screws, nails, clamps or the like. Instead, panels may be constructed with grooves, which receive structure members 38. The panels may be made of weatherproof material such as plastic, fiberglass, or the like. Permanent structure members 38 may, instead, be constructed in the form of a panel. In this manner, permanent structure members 38 may provide the permanence of the geodesic dome structure as well as enclose the geodesic dome structure.

Temporary spacers 12, connectors 14, permanent structure members 38, and the panels may come in a kit. The kit may come with spacers 12, connectors 14, permanent structure members 38, and the panels color-coded in order to aid in the construction. The kit and construction method provide a way of constructing livable geodesic structures in a matter of hours, and with little manual labor. It may be useful for providing shelter for those who have lost homes from natural disasters, wars, or the like. However, the geodesic dome structures may have alternative uses such as an advertising billboard or decoration. Temporary spacers 12 and other components may also be manufactured to extremely small tolerances, thus assuring the completed domes will approach the theoretical geometries of the desired dome, in turn, increasing the stability of the dome. The fine precision in manufacturing the components of the dome also promotes ease of assembly.

Figure 7:
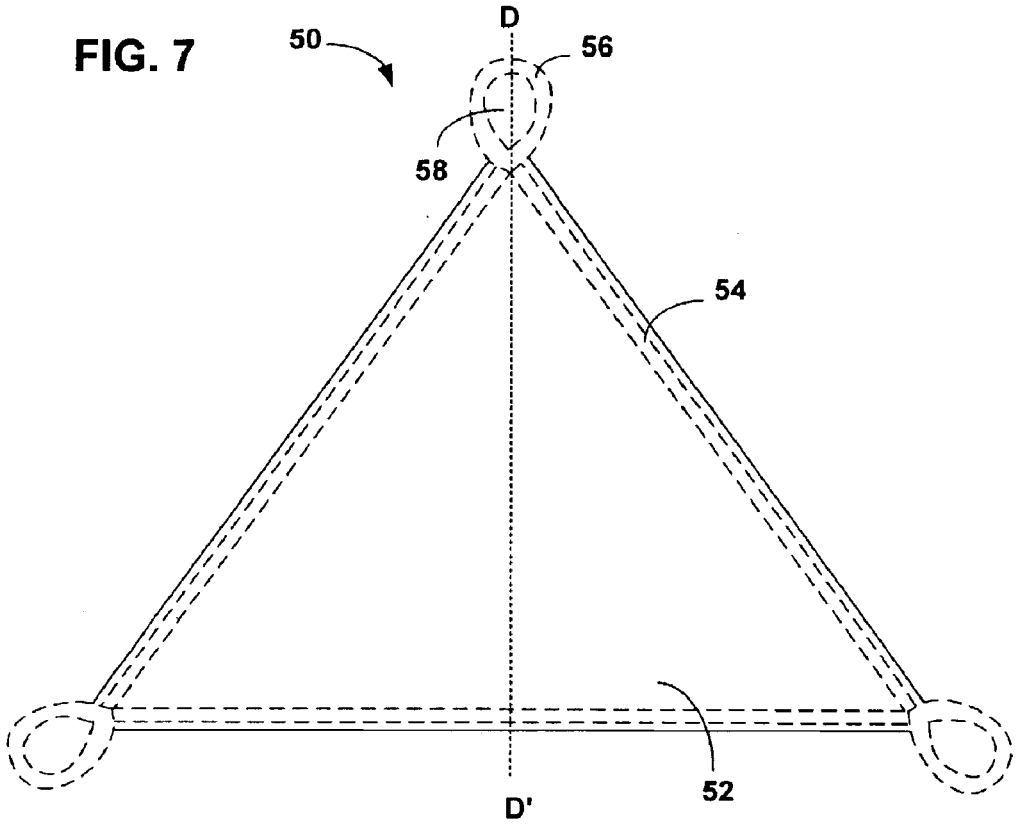
FIG. 7 is a schematic diagram illustrating a spacer, which also serves as a panel structure member that provides the permanent support structure of a geodesic dome, while concurrently enclosing the geodesic dome.
Figure 7:
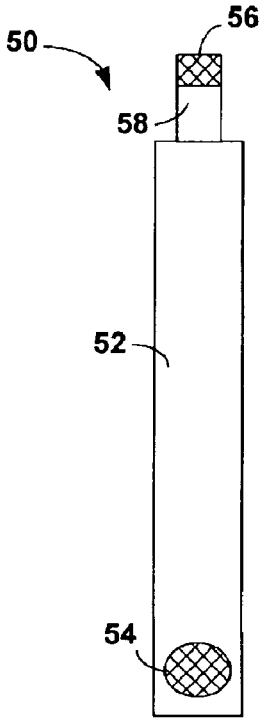

FIG. 7A is a schematic diagram illustrating spacer 50, which also serves as a panel structure member that references the connectors with respect to one another in space as well as provides the permanent support structure of geodesic dome 10 and concurrently encloses geodesic dome 10. Spacer 50 comprises a panel 52, which has an embedded permanent structure member. In the embodiment shown in FIG. 7, panel 52 has an embedded cable 54 that provides spacer 50 with the capacity to serve as a permanent structure member, as well as an enclosing member. Other permanent structure members, such as wood, steel, plastic or the like, may be embedded in panel 52 to provide the necessary support. Embedded cable 54 forms a loop 56 at each vertex of spacer 50. The loop 56 of embedded cable 54 creates an opening 58. Opening 58 may be used to attach spacer 50 to connector 14. Spacer 50 may be shaped like an isosceles triangle, equilateral triangle, or any other polygon. Panel 52 may be constructed of a material that is not strong enough to provide the permanence of geodesic dome 10 such as a synthetic material, a thin plastic or the like.

FIG. 7B is a schematic diagram illustrating a cross section view of spacer 50 of FIG. 7A from D to D'. Loop 56 of embedded cable 54 creates opening 58. Opening 58 may fasten to connector 14. Cable 54 may be embedded near the edge of panel 52. Furthermore, cable 54 may be embedded elsewhere throughout panel 52.

Spacer 50 may fasten to connector 14. In the embodiment shown in FIG. 7, opening 58 created by loop 56 of embedded cable 54 receives fastening member 32 of connector 14. Loop 56 of panel structure member 50 may be held firmly in place by the tension in the cable after each of loops 56 has been attached to corresponding connectors 14. Alternatively, an epoxy, glue, bolt, nail, or the like may aid in keeping loop 56 fastened firmly to connector 14. Furthermore, a cap may be placed on the end of fastening member 32. The cap may prevent loop 56 from sliding off the end of fastening member 32.

Using spacer 50, referencing connectors 14 in space with respect to one another, providing permanence to geodesic dome 10 and enclosing geodesic dome 10 may be done in the same step. For instance, instead of placing permanent structure members 38, removing temporary spacers 12 and attaching panels to enclose dome 10, spacer 50 may be fastened to connectors 14. Spacer 50 may reduce the number of steps in the construction process of geodesic dome 10.

Figure 8:
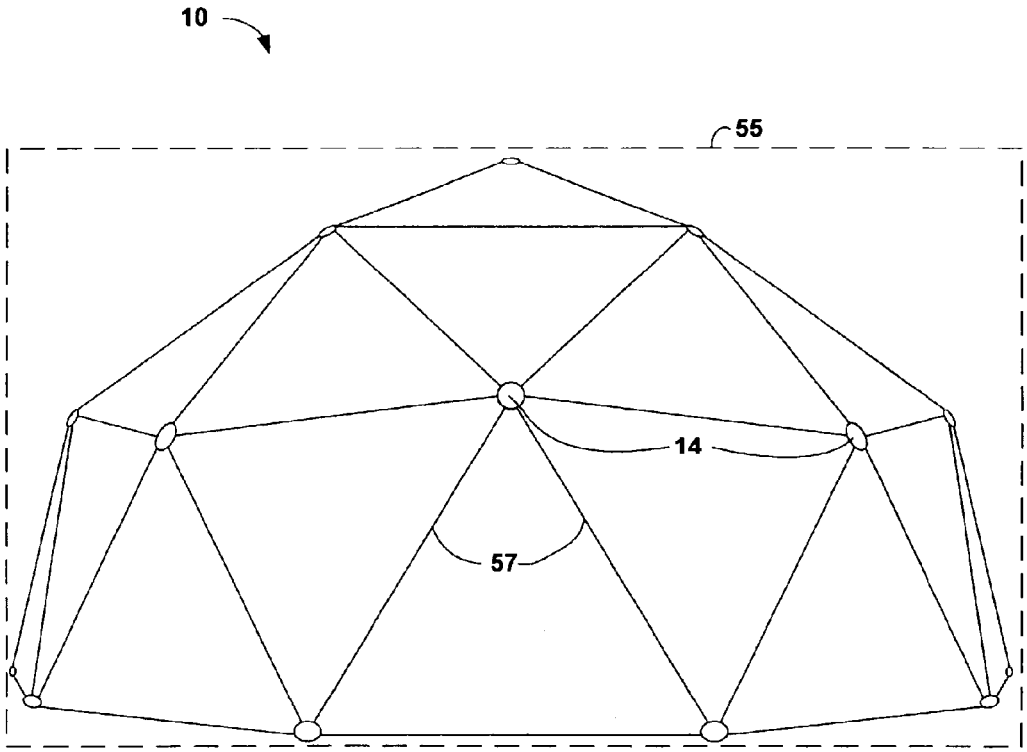
FIG. 8 is a schematic diagram illustrating an erected wire mesh that references a plurality of connectors with respect to one another in space to form the geometries of a geodesic dome.

FIG. 8 is a schematic diagram illustrating an erected wire mesh 55 that references a plurality of connectors 14 with respect to one another in space to form the geometries of a geodesic dome 10. In the embodiment shown in FIG. 1, temporary spacers 12 were used to reference connectors 14. In the embodiment shown in FIG. 8, a plurality of strands of woven wire 57 is attached between each of connectors 14 to create a wire mesh 55. In this manner, the strands of woven wire act as temporary spacers. Wire mesh 55 may be used to reference connectors 14. Strands of wire 57 may be pre-cut to the proper lengths. Alternatively, strands of wire 57 may need to be cut to proper lengths during the construction process. Strands of wire 57 attached to connectors 14 form wire mesh 55. In order to reference connectors 14 with respect to one another in space, wire mesh 55 may be erected. Temporary support platforms, a crane or the like may be used to erect wire mesh 55. The wire strands may be constructed of flexible material such as nylon.

Figure 9:
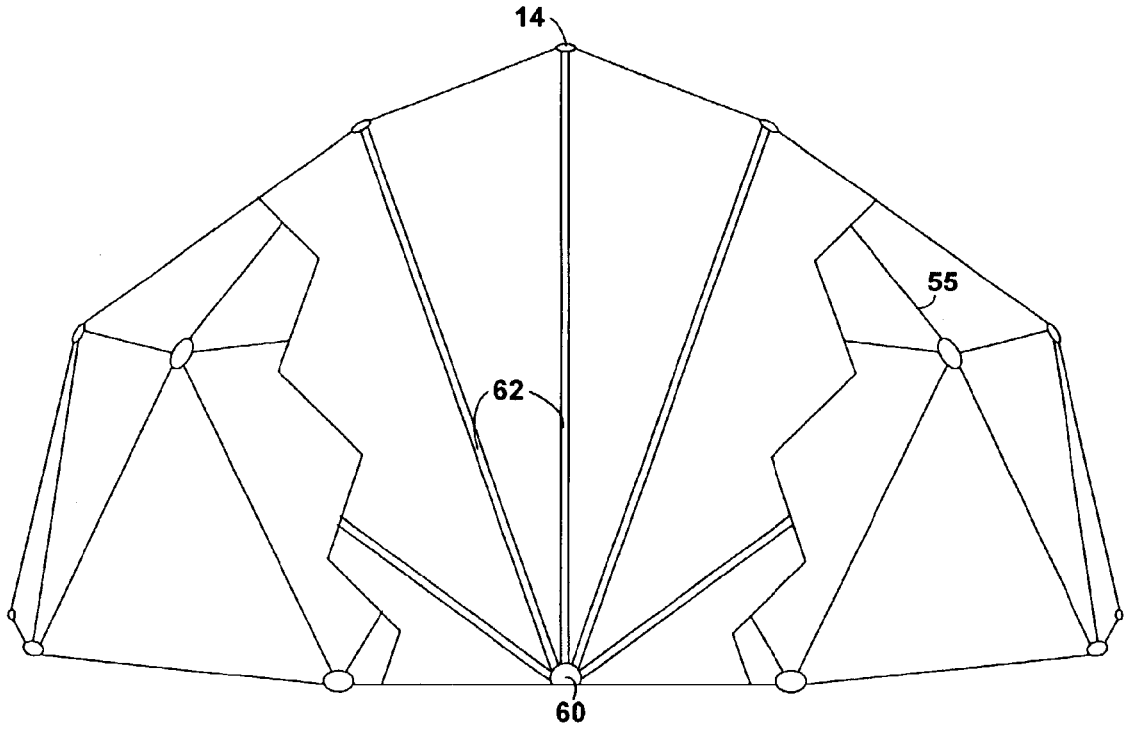
FIG. 9 is a schematic diagram illustrating an internal view of the wire mesh of FIG. 8.

FIG. 9 is a schematic diagram illustrating an internal view of the wire mesh 55 of FIG. 8 being erected using a temporary support platform 60. Temporary support platform 60 has a plurality of temporary beams 62 that extend from platform 60 to connectors 14. Each connector 14 of the mesh 55 is erected by one of beams 62. Instead of all of beams 62 being collected at platform 60, each of beams 62 may extend from corresponding connector 14 straight to the ground. Beams 62 may be constructed of wood, steel, plastic or the like.

Figure 10:
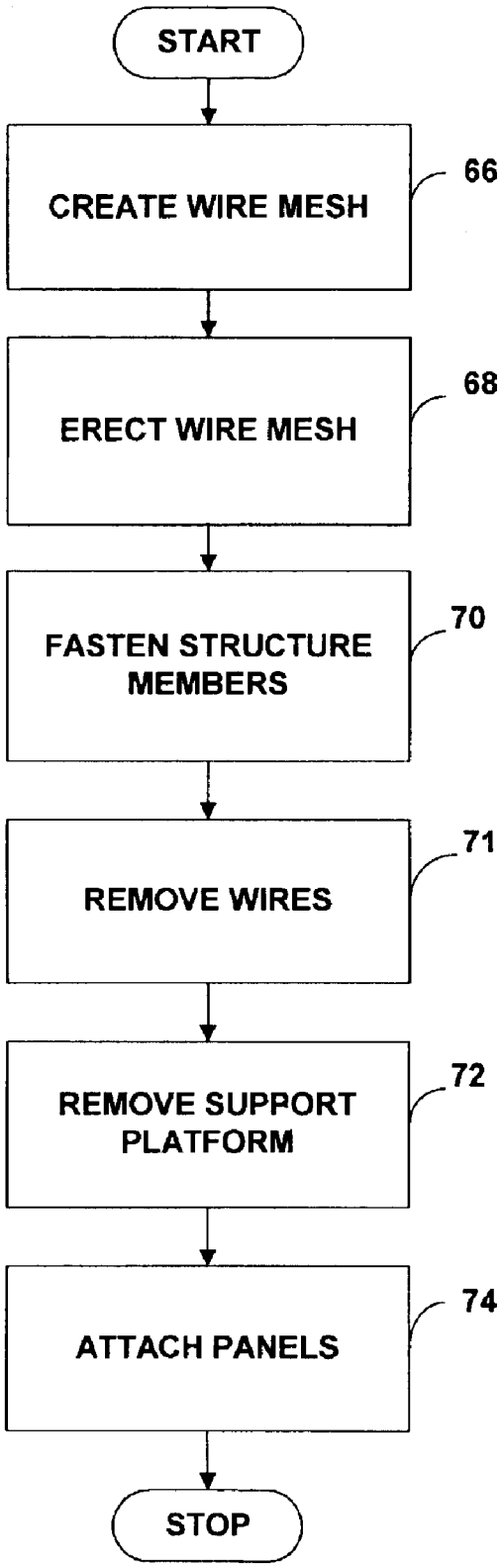
FIG. 10 is a flow chart illustrating the construction of a geodesic dome using wire mesh.

FIG. 10 is a flow chart illustrating the construction of geodesic dome 10 using wire mesh 55. A strand of woven wire 57 is attached between each of connectors 14 and its neighboring connectors 14 to create a wire mesh 55 (66). In this manner, the strands of woven wire act as the temporary spacers. Strands of wire 57 may be pre-cut to the proper lengths. Alternatively, strands of wire 57 may need to be cut to appropriate lengths during the construction process. Furthermore, a single strand of wire 57 may be attached between two or more connectors 14. In fact, one strand of wire may attach to all of connectors 14.

Wire mesh 55 may be erected to form the geometries of geodesic dome 10 (68). Once erected, wire mesh 55 references connectors 14 with respect to one another to form the geometries of geodesic dome 10. Wire mesh 55 may be erected in numerous fashions, including using temporary support platform 60, using a crane or the like.

Permanent structure members 38 may be fastened to connectors 14 of wire mesh 55 to form the permanent structure of geodesic dome 10 (70). Permanent structure members 38 may be placed on top of or under each strand of wire 57. As permanent structure members are being placed, wires 57 may be removed (71). Alternatively, the entire wire mesh 55 may be removed at the same time. However, wires 57 may remain as a passive component of geodesic dome 10. Beams 62 of temporary support platform 60 may also be removed as permanent structure members 38 are being fastened to connectors 14 (72). Alternatively, temporary beams 62 may be kept in place until all permanent structure members 38 are in place.

Panels may be attached to permanent structure members 38 and connectors 14 to enclose geodesic dome structure 10 (74). The panels may be attached to connectors 14, to permanent structure members 38, or both. The panels may be attached to connectors 14 in the same fashion as structure members 38 are attached to connectors 14. The panels may be attached to permanent structure members 38 using fasteners such as bolts, screws, nails, clamps or the like. Instead, panels may be constructed with grooves, which receive structure members 38. The panels may be made of weatherproof material such as plastic, fiberglass, or the like.

The materials used to construct geodesic dome 10 may come as a kit. The kit may include connectors 14 with wires 57 already attached. However, the kit may come with no pre-assembly of materials. The materials may be color-coded to aid in construction.

Figure 11:
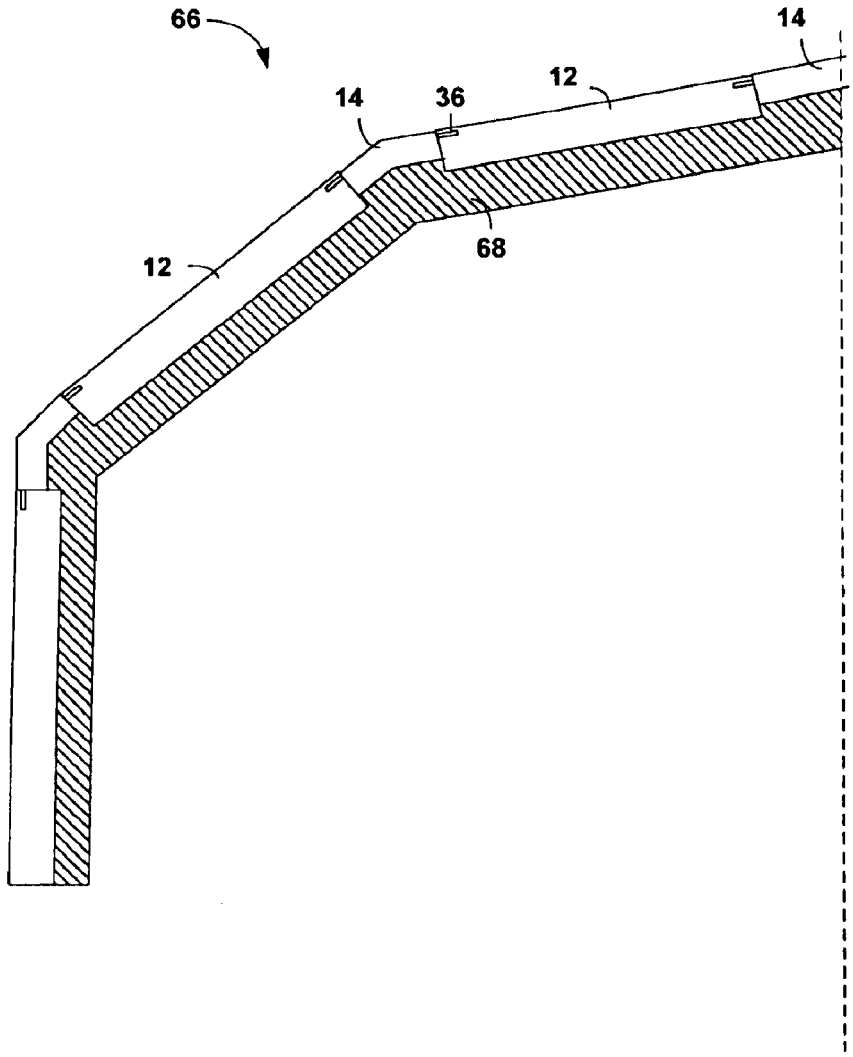
FIG. 11 is a schematic diagram illustrating a cross section view of a geodesic dome constructed using a curing material.

FIG. 11 is a schematic diagram illustrating a cross section view of a geodesic dome 66 constructed using a curing material 68. Geodesic dome structure 10 includes an outer layer that is constructed of temporary spacers 12 and connectors 14. An inner layer of geodesic dome 66 comprises curing material 68 that sets, in turn making geodesic dome 66 permanent. In this manner, curing material 68 acts as the permanent structure members. Curing material 68 may be spray-on cement, fiberglass, epoxy, or the like. The layers of geodesic dome 66 may be reversed. For example, the layer comprising spacers 12 and connectors 14 may be the inner layer, while the layer of curing material 68 may be the outer layer.

Figure 12:
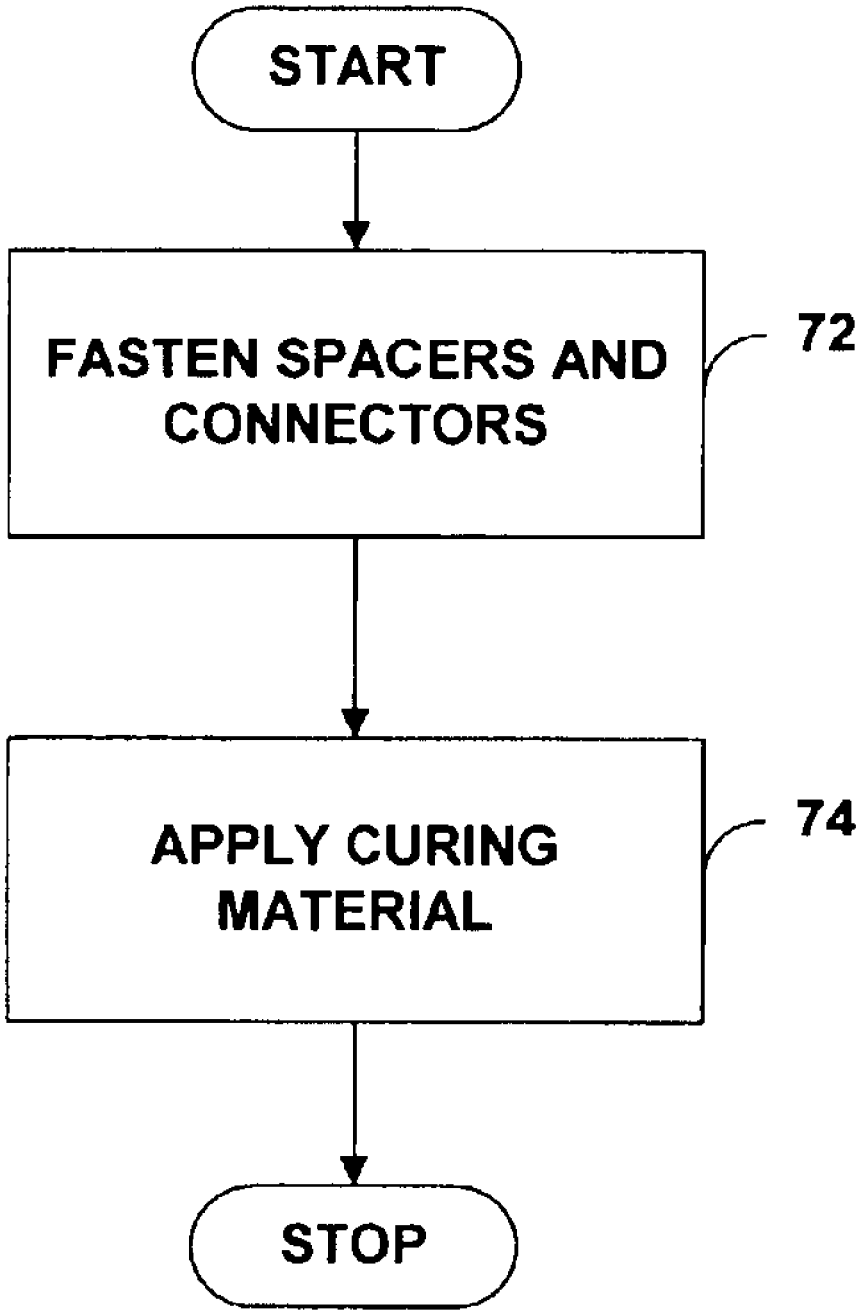
FIG. 12 is a flow chart illustrating the construction of geodesic dome of FIG. 11.

FIG. 12 is a flow chart illustrating the construction of geodesic dome 66 of FIG. 11. A set of temporary spacers 12B (FIG. 2) is fastened to a set of connectors 14 to reference connectors 14 in space relative to one another (72). Connectors 14 and temporary spacers 12B form the geometries of geodesic dome structure 10. Spacers 12B may be fastened to connectors 14 using bolts, screws, nails, clamps or the like. Spacers 12B may be fastened to connectors 14 beginning from a tier at ground level and building upwards. Alternatively, spacers 12B may be fastened to connectors 14 beginning with a top level tier and building downwards.

A curing material 68 may be applied to the geodesic dome structure 10 to provide the permanence of geodesic dome 66 (74). In this manner, curing material 68 acts as the permanent structure members. Curing material 68 may be applied to the inside of spacers 12B and connectors 14. Alternatively, curing material 68 may be applied to the outside of spacers 12B and connectors 14. In time, curing material 68 sets forming geodesic dome structure 66.

Figure 13:
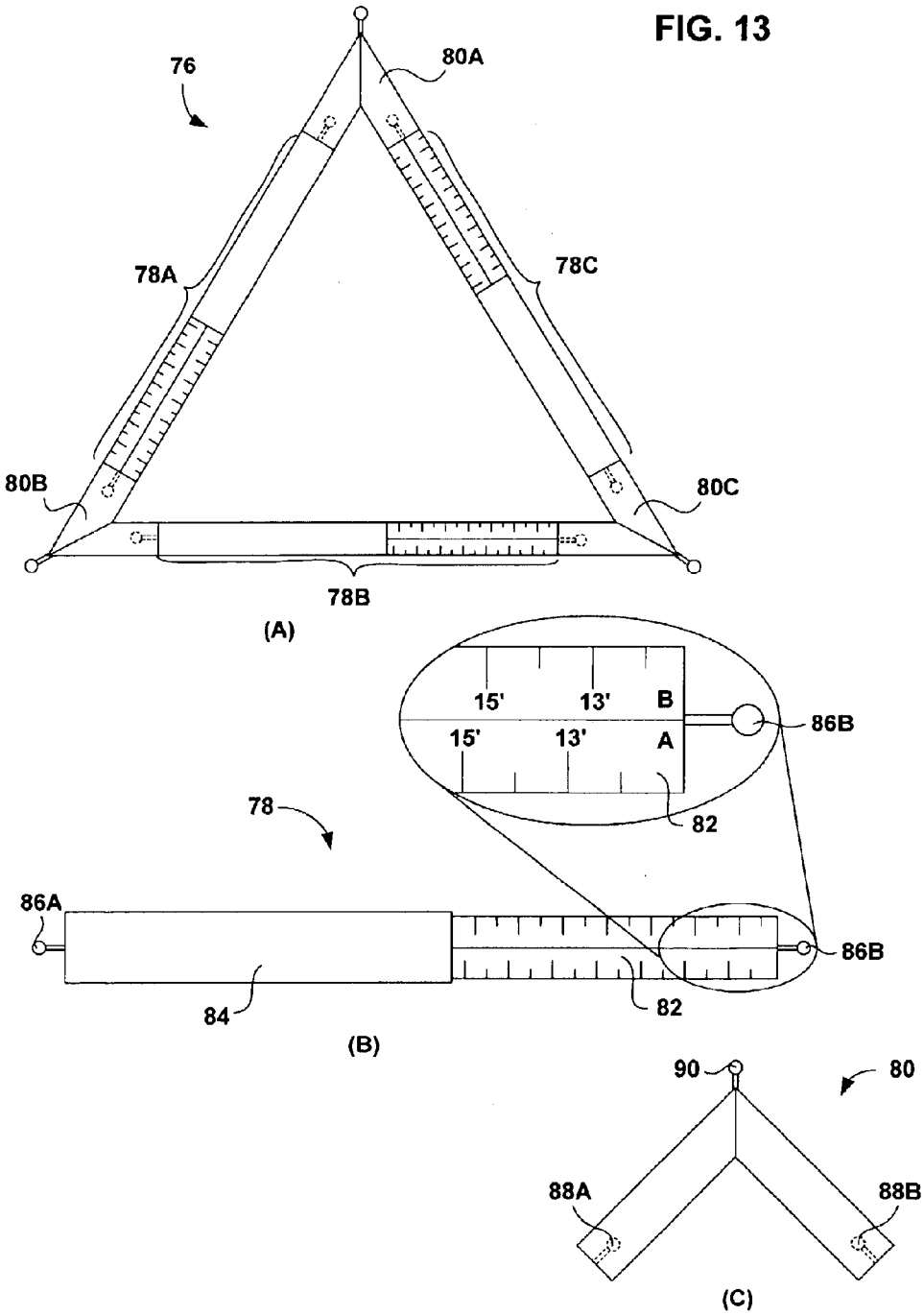
FIG. 13 is a schematic diagram illustrating a spacer that includes variable spacer arms that may be used to generate domes of various diameters.

FIG. 13 is a schematic diagram illustrating another exemplary temporary spacer used to construct the geometries of a geodesic dome. FIG. 13A illustrates a variable spacer 76 constructed of variable spacer arms 78A–78C ("variable spacer arms 78") and hinges 80A–80C ("hinges 80"). More particularly, variable spacer arms 78 are adjusted to a particular length and then coupled to hinges 80 to form variable spacer 76. Variable spacer arms 78 may, for example, be adjusted depending on a diameter or radius of a desired geodesic dome.

Variable spacer 76 and variable spacer arms 78 may be constructed of a rigid, yet lightweight material such as plastic. In the embodiment shown in FIG. 13A, variable spacer 76 is formed in the shape of a triangle. However, variable spacer 76 may be formed in the shape of any polygon or other shape that will define and hold the geometries in space until the desired geometries are fixed permanently in space.

FIG. 13B illustrates one of variable spacer arms 78 in further detail. Variable spacer arm 78 includes a calibrated portion 82 to allow variable spacer arm 78 to be adjusted to different lengths and a housing portion 84 to accept calibrated portion 82. Each end of variable spacer arm 78, i.e., the end of calibration portion 82 and housing portion 84, includes fasteners 86A and 86B ("fasteners 86") to couple variable spacer arm 78 to hinges 80. Variable spacer arm 78 and, more particularly, calibrated portion 82 and housing portion 84 may have tubular shapes. The radius of calibrated portion 82 may be smaller that housing portion 84 such that calibrated portion may extend from and retract into housing portion 84. Calibrated portion 82 and housing portion 84 may take on different shapes. For example, calibrated portion 82 and housing portion 84 may be flat, rectangular, or any other shape as long as calibrated portion 82 extends from and retracts into housing portion 84. However, calibrated portion 82 need not retract into housing portion 84 as long as the length of a side and vertex angles of variable spacer 76 may be adjusted. For instance, a spacer may include a calibrated portion that may be fixed in relation to other portions of the spacer and adjusted to form spacers of different lengths.

Calibrated portion 82 may include settings for easy adjustment of variable spacer arm 78 to particular lengths. For example, calibrated portion 82 may include settings that correspond to geodesic domes of varying radii. In this manner, calibrated portion 82 extends from housing portion 84 to a setting in accordance with the radius of a desired geodesic dome. The settings may correspond to other factors including diameter, circumference, or the like.

Calibrated portion 82 may further include multiple setting scales for adjustment of variable spacer arm 78. The multiple setting scales may be used in order to adjust variable spacer arm 78 for spacers that have more than one length. For example, when adjusting calibrated portion 82 for a spacer that is shaped like an isosceles triangle, variable spacer arms 78 must be adjusted to different lengths. As illustrated in the example of FIG. 13B, calibrated portion 82 may include a first setting that corresponds to a first length, e.g., a base length of the isosceles triangle, and a second setting that corresponds to a second length, e.g., a side length of the isosceles triangle. A spacer shaped like an isosceles triangle, for example, may include two variable spacer arms adjusted using the second setting scale and one variable spacer arm adjusted using the first setting scale. Both of the setting scales may be calibrated to correspond to geodesic domes of varying radii, diameter, circumference or the like. The setting scales may further be color-coded.

FIG. 13C illustrates one of hinges 80 in further detail. Hinge 80 is shaped to form variable spacer 76 upon coupling to variable spacer arms 78. Hinge 80 includes slots 88A and 88B ("slots 88") to accept and hold fasteners 86 from variable spacer arms 78. More specifically, slot 88A accepts a fastener 86 from a first variable spacer arm 78 and slot 88B accepts a fastener 86 from as second variable spacer arm 78. Hinge 80 may further include a hook 90 to attach an assembled variable spacer 76 to other spacers at a vertex of a geodesic dome. Hinge 80 may be constructed from materials such as steel, rigid plastic, or the like.

A number of embodiments of the present invention have been described. Nevertheless, it will be understood that various modifications may be made without departing from the spirit and scope of the invention. Accordingly, other embodiments are within the scope of the following claims.

What is claimed is:

1. A method comprising:

assembling a set of connectors and set of temporary spacers to form the geometries of a geodesic dome;

fastening permanent structure members to the connectors to form a permanent geodesic dome structure; and removing the temporary spacers.

2. The method of claim 1, further comprising enclosing the geodesic dome structure.

3. The method of claim 1, wherein enclosing the geodesic dome structure includes fastening panels to the permanent structure members.

4. The method of claim 1, wherein assembling the set of connectors and the set of temporary spacers includes fastening the temporary spacers to the connectors with fasteners.

5. The method of claim 4, wherein assembling the set of connectors comprises fastening the temporary spacers to the connectors with at least one of screws, bolts, nails and clamps.

6. The method of claim 1, wherein assembling a set of connectors and set of temporary spacers to form the geometries of a geodesic dome includes:

attaching one or more strands of wire between the connectors to create a wire mesh; and erecting the wire mesh to form the geometries of the geodesic dome.

7. The method of claim 6, wherein the strands of wire comprise one of nylon wire and cable.

8. The method of claim 1, further comprising forming the temporary spacers in the shape of polygons.

9. The method of claim 8, wherein forming the temporary spacers comprises forming the polygons are triangles.

10. The method of claim 1, wherein assembling a set of connectors and set of temporary spacers comprises assembling the set of connectors with temporary spacers of at least two different sizes.

11. The method of claim 1, wherein the temporary spacers include spacer arms that adjust to form temporary spacers of different sizes.

12. The method of claim 11, wherein the spacer arms have settings that depend on a size of a desired geodesic dome.

13. The method of claim 1, wherein assembling a set of connectors and set of temporary spacers comprises assembling the set of connectors with the temporary spacers constructed of one of plastic or polystyrene.

14. The method of claim 1, wherein assembling a set of connectors and set of temporary spacers comprises assembling the set of connectors with the temporary spacers constructed of a solid sheet of material.

15. The method of claim 1, wherein assembling a set of connectors and set of temporary spacers comprises assembling the set of connectors with the temporary spacers constructed with a hole.

16. The method of claim 1, wherein assembling a set of connectors and set of temporary spacers comprises assembling with connectors that take the shape of one or more polygons.

17. The method of claim 16, wherein the shape of the connectors depends on the number of temporary spacers that couple to the connectors.

18. The method of claim 1, wherein fastening permanent structure members to the connectors to form a permanent geodesic dome structure includes applying a curing material.

19. The method of claim 18, wherein the curing material includes at least one of spray-on cement, fiberglass, and epoxy.

20. The method of claim 1, wherein the permanent structure members are constructed from at least one of wood, plastic, steel, and cable.

21. The method of claim 1, wherein removing the temporary spacers includes removing the temporary spacers upon fastening all of the permanent structure members to the connectors.

22. The method of claim 1, further comprising assembling another set of connectors using the removed temporary spacers to form the geometries of another geodesic dome, while simultaneously enclosing the first geodesic structure.

23. An apparatus comprising:

a set of connectors;

a set of removable temporary spacers, the temporary spacers connected to the connectors to form the geometries of a geodesic dome; and a set of permanent structure members that fasten to the connectors to form a permanent geodesic structure.

24. The apparatus of claim 23, wherein the set of temporary spacers are constructed in the shape of one or more polygons.

25. The apparatus of claim 24, wherein the polygons are triangles.

26. The apparatus of claim 25, wherein the triangles are isosceles triangles and equilateral triangles.

27. The apparatus of claim 23, wherein the temporary spacers are constructed of a solid sheet of material.

28. The apparatus of claim 23, wherein the temporary spacers are constructed with a hole in the middle.

29. The apparatus of claim 23, wherein the temporary spacers are constructed of one of plastic or polystyrene.

30. The apparatus of claim 23, wherein the temporary spacers comprise strands of wire that extend between the connectors to form a wire mesh, and the wire mesh is erected to form the geometries of the geodesic dome.

31. The apparatus of claim 30, wherein the strands of wire comprise nylon wire or cable.

32. The apparatus of claim 23, wherein the connectors are shaped in the form of one or more polygons.

33. The apparatus of claim 32, wherein the shape of the connectors is dependent on the number of temporary spacers that are coupled to the connector.

34. The apparatus of claim 32, wherein the polygons comprise hexagons and pentagons.

35. The apparatus of claim 23, wherein the connectors are constructed of one of steel and plastic.

36. The apparatus of claim 23, wherein the permanent structure members are constructed from at least one of wood, plastic, steel, and cable.

37. The apparatus of claim 23, wherein the permanent structure members include a curing material that is applied to form a permanent geodesic structure.

38. The apparatus of claim 37, wherein the curing material is one of spray-on cement, spray-on fiberglass, and an epoxy.

39. The apparatus of claim 23, wherein the permanent structure members enclose the geodesic structure.

40. The apparatus of claim 23, further comprising panels to enclose the geodesic structure.

41. The apparatus of claim 23, wherein the temporary spacers include:

a set of spacer arms; and a set of hinges that couple to the spacer arms to form the temporary spacers.

42. The apparatus of claim 41, wherein the spacer arms are extendable to form temporary spacers of different sizes.

43. The apparatus of claim 41, wherein the spacer arms have settings that depend on a size of a desired geodesic dome.

44. The apparatus of claim 43, wherein the settings depend on at least one of a radius, a diameter, and a circumference of the desired geodesic dome.

45. A method comprising:

assembling a set of connectors and set of temporary spacers to form the geometries of a first geodesic dome;

fastening permanent structure members to the connectors to form a first permanent geodesic dome structure;

removing the temporary spacers from the first permanent geodesic dome; and assembling another set of connectors using the temporary spacers to form the geometries of another geodesic dome while simultaneously enclosing the first permanent geodesic dome structure.

* * * * *